US006948665B2

(12) United States Patent
Joseph

(10) Patent No.: US 6,948,665 B2
(45) Date of Patent: Sep. 27, 2005

(54) FUEL INJECTOR INCLUDING AN ORIFICE DISC, AND A METHOD OF FORMING THE ORIFICE DISC WITH AN ASYMMETRICAL PUNCH

(75) Inventor: J. Michael Joseph, Newport News, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 150 days.

(21) Appl. No.: 10/608,389

(22) Filed: Jun. 30, 2003

(65) Prior Publication Data

US 2004/0262430 A1 Dec. 30, 2004

(51) Int. Cl.[7] ..... F02M 59/00; F02M 39/00; B05R 1/30

(52) U.S. Cl. ..... 239/533.2; 239/533.3; 239/585.5; 239/585.1; 239/585.4; 239/88

(58) Field of Search ..... 239/533.2, 533.3, 239/533.14, 585.1–585.5, 88–93, 483, 489, 494, 495, 497; 251/129.15, 129.21, 127; 417/477.2, 477.3, 477.12; 604/153

(56) References Cited

U.S. PATENT DOCUMENTS

| | | | | |
|---|---|---|---|---|
| 335,334 A | | 2/1886 | Brady | |
| 600,687 A | | 3/1898 | Flemming | |
| 2,737,831 A | | 3/1956 | Webb | |
| 2,846,902 A | | 8/1958 | Cowley | |
| 4,072,039 A | | 2/1978 | Nakanishi | |
| 4,923,169 A | | 5/1990 | Grieb et al. | |
| 4,970,926 A | | 11/1990 | Ghajar et al. | |
| 5,002,231 A | | 3/1991 | Reiter et al. | |
| 5,201,806 A | | 4/1993 | Wood | |
| 5,335,864 A | | 8/1994 | Romann et al. | |
| 5,344,081 A | | 9/1994 | Wakeman | |
| 5,350,119 A | * | 9/1994 | Bergstrom | 239/585.4 |
| 5,365,819 A | | 11/1994 | Maida et al. | |
| 5,553,397 A | | 9/1996 | Schwitzky et al. | |
| 5,365,819 A | | 4/1997 | Maida et al. | |
| 5,636,796 A | | 6/1997 | Oguma | |
| 5,697,154 A | | 12/1997 | Ogihara | |
| 5,730,368 A | | 3/1998 | Flik et al. | 239/575 |
| 5,746,376 A | | 5/1998 | Romann et al. | |
| 5,816,093 A | | 10/1998 | Takeuchi et al. | |
| 5,931,391 A | | 8/1999 | Tani et al. | 239/585.4 |
| 6,009,787 A | | 1/2000 | Häanggi | |
| 6,039,271 A | | 3/2000 | Reiter | |
| 6,070,812 A | | 6/2000 | Tani et al. | |
| 6,089,476 A | | 7/2000 | Sugimoto et al. | |
| 6,131,826 A | | 10/2000 | Teiwes | |

FOREIGN PATENT DOCUMENTS

| | | |
|---|---|---|
| JP | 3529223121 | 12/1984 |
| JP | 60137529 | 7/1985 |
| JP | 352032192 | 3/1997 |
| JP | 11117830 | 4/1999 |
| JP | 2003120473 | 4/2003 |

OTHER PUBLICATIONS

PCT International Search Report filed Jun. 21, 2004 (PCT/US2004/019703) and date of mailing Oct. 14, 2004.

* cited by examiner

*Primary Examiner*—Davis Hwu

(57) ABSTRACT

A fuel injector includes a seat, a movable member cooperating with the seat, and an orifice plate. The metering orifice disc includes a member having first and second generally parallel surfaces, and an orifice penetrating the member. The first surface generally faces the seat and represents the fuel entry side. The second surface faces opposite the first surface and represents the fuel exit side. The orifice is defined by a wall that couples the first and second surfaces. And the wall includes first and second portions. The first portion is spaced from the first surface and extends generally parallel to a longitudinal axis. The second portion couples the first portion to the first surface and extends at a first oblique angle that varies with respect to the first surface.

19 Claims, 4 Drawing Sheets

FUEL INJECTOR INCLUDING AN ORIFICE DISC, AND A METHOD OF FORMING THE ORIFICE DISC WITH AN ASYMMETRICAL PUNCH

FIELD OF INVENTION

This invention relates generally to electrically operated fuel injectors of the type that inject volatile liquid fuel into an automotive vehicle internal combustion engine, and in particular the invention relates to a novel thin disc orifice member for such a fuel injector.

BACKGROUND OF THE INVENTION

It is believed that contemporary fuel injectors must be designed to accommodate a particular engine, not vice versa. The ability to meet stringent tailpipe emission standards for mass-produced automotive vehicles is at least in part attributable to the ability to assure consistency in both shaping and aiming the injection spray or stream, e.g., toward intake valve(s) or into a combustion cylinder. Wall wetting should be avoided.

Because of the large number of different engine models that use multi-point fuel injectors, a large number of unique injectors are needed to provide the desired shaping and aiming of the injection spray or steam for each cylinder of an engine. To accommodate these demands, fuel injectors have heretofore been designed to produce straight streams, bent streams, split streams, and split/bent streams. In fuel injectors utilizing thin disc orifice members, such injection patterns can be created solely by the specific design of the thin disc orifice member. This capability offers the opportunity for meaningful manufacturing economies since other components of the fuel injector are not necessarily required to have a unique design for a particular application, i.e. many other components can be of common design.

Another concern in contemporary fuel injector design is minimizing the so-called "sac volume." As it is used in this disclosure, sac volume is defined as a volume downstream of a needle/seat sealing perimeter and upstream of the orifice hole(s). The practical limit of dimpling a geometric shaped into an orifice disc pre-conditioned with straight orifice holes is the depth or altitude of the geometric shape required to obtain the desired spray angle(s). Obtaining the larger bend and split spray angles makes the manufacture more difficult and increases sac volume at the same time. At the same time, as the depth of the geometry increases, the amount of individual hole and dimple distortion also increases. In extreme instances, the disc material may shear between holes or at creases in the geometrical dimple.

SUMMARY OF THE INVENTION

The present invention provides a fuel injector for spray targeting fuel. The fuel injector includes a seat, a movable member cooperating with the seat, and an orifice plate. The seat includes a passage that extends along a longitudinal axis, and the movable member cooperates with the seat to permit and prevent a flow of fuel through the passage. The metering orifice disc includes a member having first and second generally parallel surfaces, and an orifice penetrating the member. The first surface generally confronts the seat, and the second surface faces opposite the first surface. The orifice is defined by a wall that couples the first and second surfaces. And the wall includes first and second portions. The first portion is spaced from the first surface and extends substantially perpendicular to the first and second generally planar surfaces. The second portion couples the first portion to the first surface and extends at a first oblique angle that varies with respect to the first surface.

The present invention also provides a metering orifice disc for a fuel injector. The fuel injector includes a passage that extends between an inlet and an outlet, a seat that is proximate the outlet, and a closure member that cooperates with the seat to permit and prevent a flow of fuel through the passage. The metering orifice disc includes a member and an orifice penetrating the member. The member includes first and second generally parallel surfaces. The first surface is adapted to generally confront the valve seat, and the second surface faces opposite the first surface. The orifice is defined by a wall that couples the first and second surfaces. The wall includes a first portion that is spaced from the first surface and a second portion that couples the first portion to the first surface. The first portion of the wall extends substantially perpendicular to the first and second generally planar surfaces. And the second portion of the wall extends at a first oblique angle with respect to the first surface. The first oblique angle vanes so as to define an asymmetrical chamfer.

The present invention also provides a method of forming a metering orifice disc for a fuel injector. The metering orifice disc includes a member that has first and second generally parallel surfaces. The method includes forming an orifice penetrating the member and deforming the orifice proximate the first surface. The orifice is defined by a wall that couples the first and second surfaces, and the orifice extends along an orifice axis that is generally perpendicular to the first and second generally parallel surfaces. The deforming includes forming an asymmetrical chamfer with respect to the orifice axis.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT(S)

Figure 1:
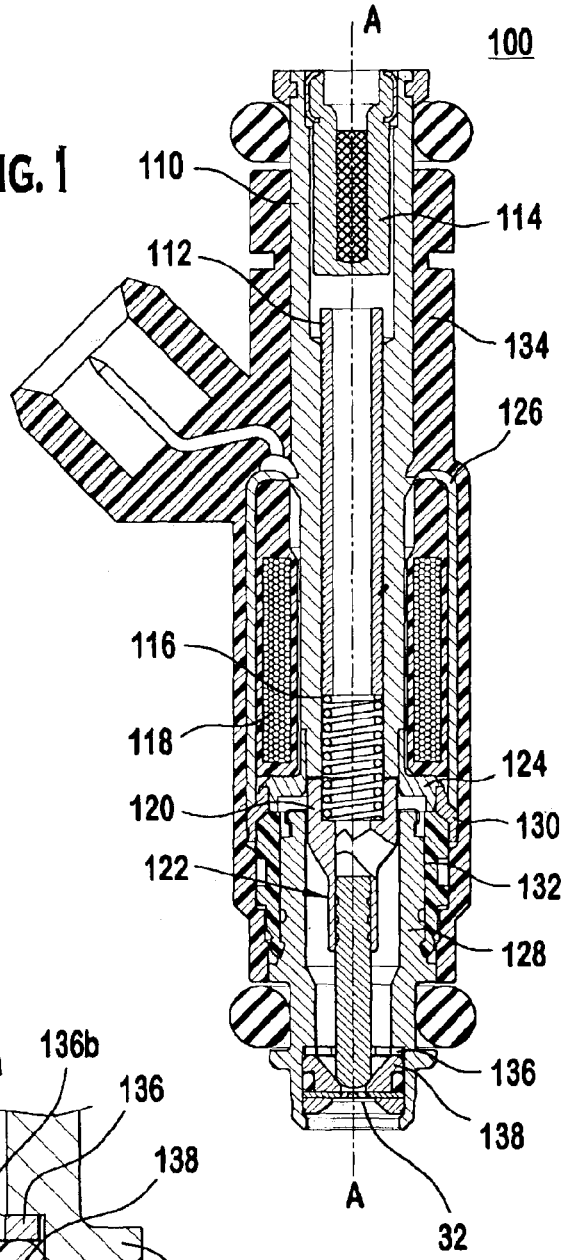
FIG. 1A is a cross-sectional view of a fuel injector according to a preferred embodiment of the present invention.
FIG. 1B is a close-up cross-sectional view of the outlet end portion of the fuel injector of FIG. 1A.

FIGS. 1–3 illustrate the preferred embodiments. In particular, a fuel injector 100 extends along a longitudinal axis A—A, as illustrated in FIG. 1A, and includes: a fuel inlet tube 110, an adjustment tube 112, a filter assembly 114, a coil assembly 118, a coil spring 116, an armature 120, a closure member assembly 122, a non-magnetic shell 124, a fuel injector overmold 134, a body 128, a body shell 130, a body shell overmold 132, a coil assembly housing 126, a guide member 136 for the closure member assembly 122, a seat 138, and a metering disc 140. The construction of fuel injector 100 can be of a type similar to those disclosed in commonly assigned U.S. Pat. Nos. 4,854,024; 5,174,505; and 6,520,421.

Figure 1B:
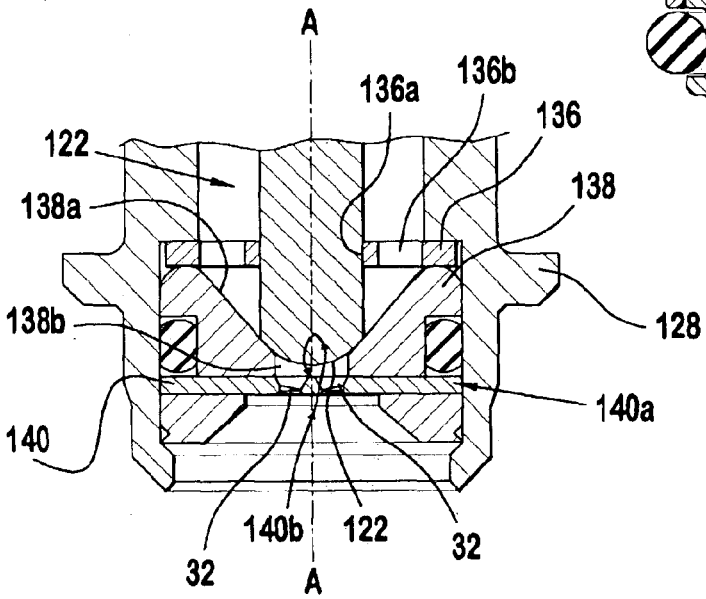

FIG. 1B shows the nozzle end of a body 128 of a solenoid operated fuel injector 100 having a metering orifice disc 140 embodying principles of the invention. The nozzle end of fuel injector 100 is also like those of the aforementioned patents including that of a stack. The stack includes a guide member 136 and a seat 138, which are disposed axially interiorly of metering orifice disc 140. The stack can be retained by a suitable technique such as, for example, a retaining lip with a retainer or by welding the disc 140 to the seat 138 and welding the seat 138 to the body 128.

Seat 138 can include a frustoconical seating surface 138*a* that leads from guide member 136 to a central passage 138*b* of the seat 138 that, in turn, leads to a central portion 140*b* of metering orifice disc 140. Guide member 136 includes a central guide opening 136*a* for guiding the axial reciprocation of a sealing end 122*a* of a closure member assembly 122 and several through-openings 136*b* distributed around opening 136*a* to provide for fuel to flow through sealing end 122*a* to the space around seat 138. FIG. 1B shows the hemispherical sealing end 122*a* of closure member assembly 122 seated on seat 138, thus preventing fuel flow through the fuel injector. When closure member assembly 122 is separated from the seat 138, fuel is permitted to pass thorough passage 138*b*, through orifices 32 extending through the metering orifice disc 140 such that fuel flows out of the fuel injector 100.

The metering orifice disc 140 can have a generally circular shape with a circular outer peripheral portion 140*a* that circumferentially bounds the central portion 140*b* that is located axially in the fuel injector. The central portion 140*b* of metering orifice disc 140 is imperforate except for the presence of one or more asymmetrical orifices 32 via which fuel passes through metering orifice disc 140. Any number of asymmetrical orifices 32 can be configured in a suitable array about the longitudinal axis A—A so that the metering orifice disc 140 can be used for its intended purpose in metering, atomizing, and targeting fuel spray of a fuel injector. The preferred embodiments include four such through-asymmetrical orifices 32 (although only two are shown in the Figures) arranged about the longitudinal axis A—A through the metering orifice disc 140.

Figure 2A:
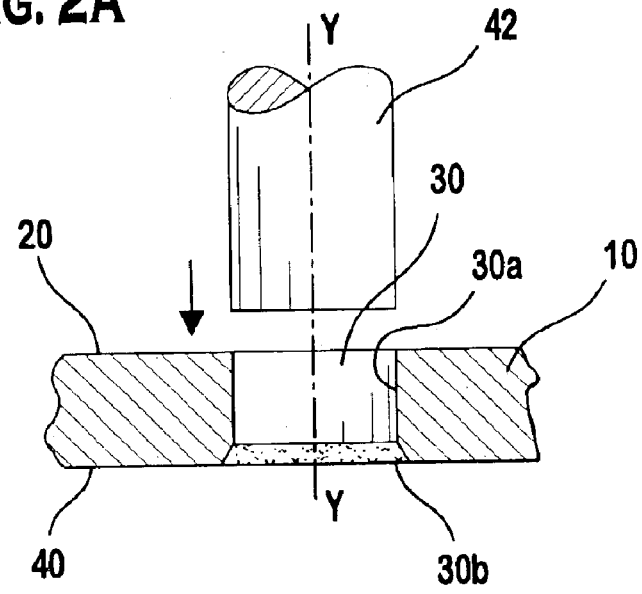
FIGS. 2A and 2B depict part of the process of forming the metering orifice disc of the preferred embodiments.
Figure 2B:
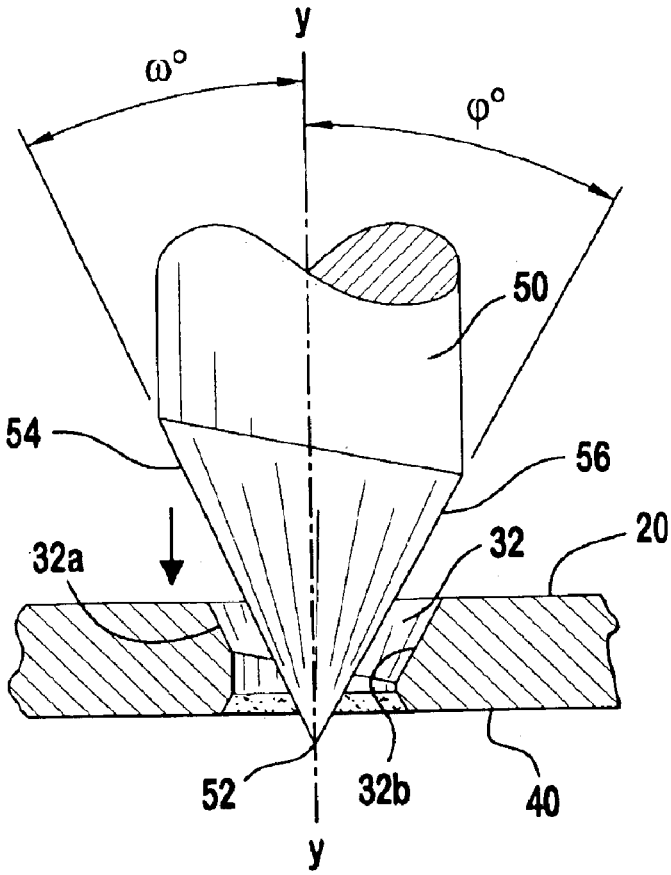

Referencing FIGS. 2A and 2B, the preferred embodiments of the metering orifice disc 140 can be formed as follows. Initially, a generally planar blank work piece 10 having a first surface 20 spaced at a distance from a second surface 40 without any orifices extending therethrough is provided. The blank 10 is penetrated by a suitable technique such as, for example, punching, coining, drilling or laser machining to form a pilot through opening or pilot orifice 30 that is symmetrical about and extending along an axis Y-Y of the tool 42 generally perpendicular to the planar surfaces 20 and 40 of the blank. Preferably, the symmetrical pilot through-opening 30 is formed by a cylindrical punch 42 that forms a perpendicular burnished wall section 30*a* between surface 20 and proximate surface 40 with a rough chamfer 30*b* formed by a breakout (i.e., a fracturing) of material by the punch tool 42 as the punch tool 42 penetrates through to the second surface 40.

The symmetrical through opening or orifice 30 is further penetrated by a suitable technique to form an asymmetrical through opening or orifice 32. Thereafter, the work piece can be processed into a metering orifice disc 140 by a suitable material finishing technique such as, for example, stamping the work piece into a desired configuration, grinding, deburring, skiving, or polishing.

Figure 2C:
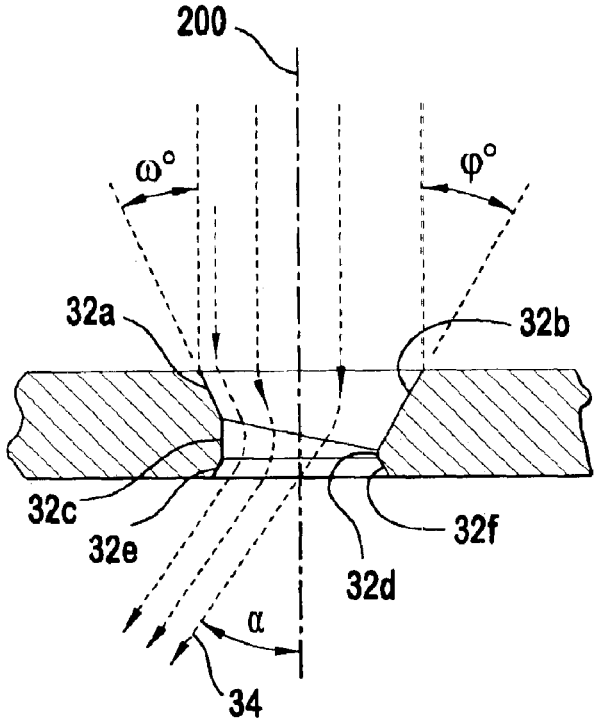
FIG. 2C depicts details of the metering orifice disc of FIG. 2B in a fragmentary cross-sectional view.
Figure 2D:
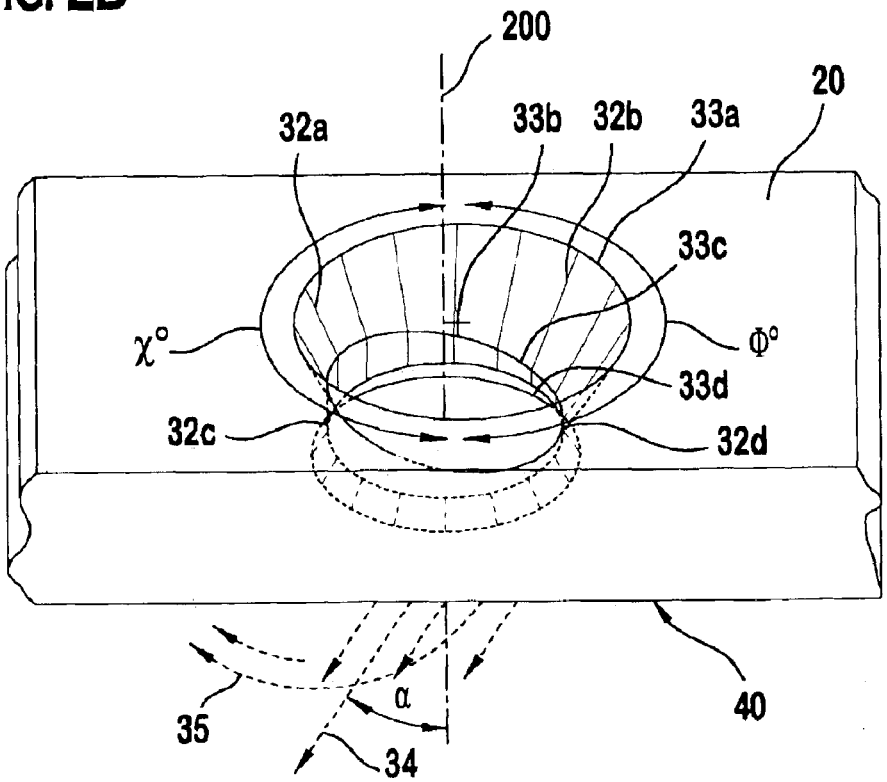
FIG. 2D depicts details of the metering orifice disc of FIG. 2B in a fragmentary perspective view.

In a preferred embodiment, the asymmetrical orifice 32 is formed by a punch tool 50 having an apex 52 with at least two leading edges disposed about the tool axis Y—Y such that the resulting cross-section of the punch tool 50 is asymmetric about the orifice axis 200 (FIGS. 2C, 2D). Each of the at least two leading edges can include a first leading edge 54 and a second leading edge 56. The first leading edge 54 is oriented at a first lead angle $\omega°$ different from the second lead angle $\phi°$ of the second leading edge 56. In one of the preferred embodiments, the first lead angle $\omega°$ is approximately 25 degrees and the second lead angle $\phi°$ is approximately 30 degrees.

Although the asymmetrical orifice 32 can be formed of a suitable cross-sectional area such as for example, square, rectangular, oval or circular, the preferred embodiments include generally circular orifices having a diameter of about 100 microns, and more particularly, about 125 microns. Preferably, the first and second surfaces 20, 40 of the metering orifice disc 140 are spaced apart over a distance of between 100 to 300 microns or greater.

The asymmetrical orifice 32 can include a first entry chamfer 32*a* disposed at a first angular extension $\chi°$ about the longitudinal axis 200 (FIGS. 2C and 2D) and merging into a second entry chamfer 32*b* disposed at a second angular extension (D) (FIGS. 2C and 2D) through a transition area due to the generated surface of the tool 50. The first entry chamfer 32*a* can be oriented at approximately the first lead angle $\omega°$. The second entry chamfer 32*b* can be oriented at approximately the second lead angle $\phi°$ such that the first and second entry chamfers 32*a* and 32*b* are asymmetrical about the tool axis Y—Y (FIG. 2B) and axis 200 (FIG. 2C). The junctures of the first and second entry chamfers with respect to the surface 20 can form a first perimeter 33*a* having a geometric center 33*b* oblique relative to the longitudinal axis (FIGS. 2D and 2C). Preferably, the perimeter 33*a* is a generally elliptical perimeter.

The first entry chamfer 32*a* leads to a first wall surface 32*c* (FIG. 2C). The first wall surface 32*c* is disposed at about the first angular extension $\chi°$ about the longitudinal axis 200 and merges into a second wall surface 32*d* disposed at the second angular extension $\Phi°$ (FIG. 2D) such that the first and second wall surfaces 32*c* and 32*d* are symmetric to axis 200. Preferably, the first wall surface 32*c* and the second wall surface 32*d* are parallel to the tool axis Y—Y, which in this case is coincident with the orifice axis 200 such that both surfaces form a cylindrical wall surface about the axis 200. The entry chamfers 32*a* and 32*b* form an asymmetric conical surface about the axis 200. The junctures between first and second chamfers 32*a*, 32*b* with first and second wall surfaces 32*c*, 32*d* form a second perimeter 33*c* (FIG. 2D) disposed generally oblique to the first and second surfaces 20, 40.

The first wall surface 32*c* can merge into a first exit chamfer 32*e*. Similarly, the second wall surface 32*d* can merge into a second exit chamfer 32*f*. The junctures of the first and second exit chamfers 32*e* and 32*f* with respect to the surface 20 can form a third perimeter having a geometric center coincident to or offset with respect to the axis 200. Preferably, the perimeter of the first and second exit chamfers 32*e* and 32*f* are symmetric to the axis 200.

Due to the asymmetrical geometry of the orifice 32, fuel 34 flowing through the orifice 32 of the metering disc 140 tends to flow through at an orifice angle α generally oblique to the longitudinal axis: Thus, even though the orifice 32 is formed by two tools moving in a perpendicular direction with respect to the first or second surfaces 20 or 40, the orifice formed is an asymmetrical orifice 32 rather than a symmetrical orifice. The asymmetrical orifice 32 essentially emulates an angled orifice (as referenced to the longitudinal axis 200) by inducing the fuel flow 34 to flow at the orifice angle approximating the angle α.

Figure 3A:
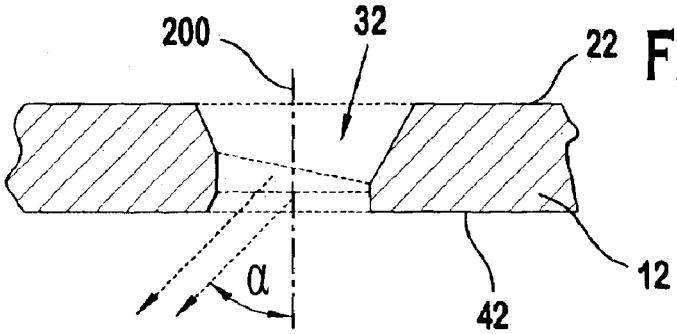
FIGS. 3A, 3B, and 3C depict yet another process of forming the metering orifice disc of the preferred embodiments.
Figure 3B:
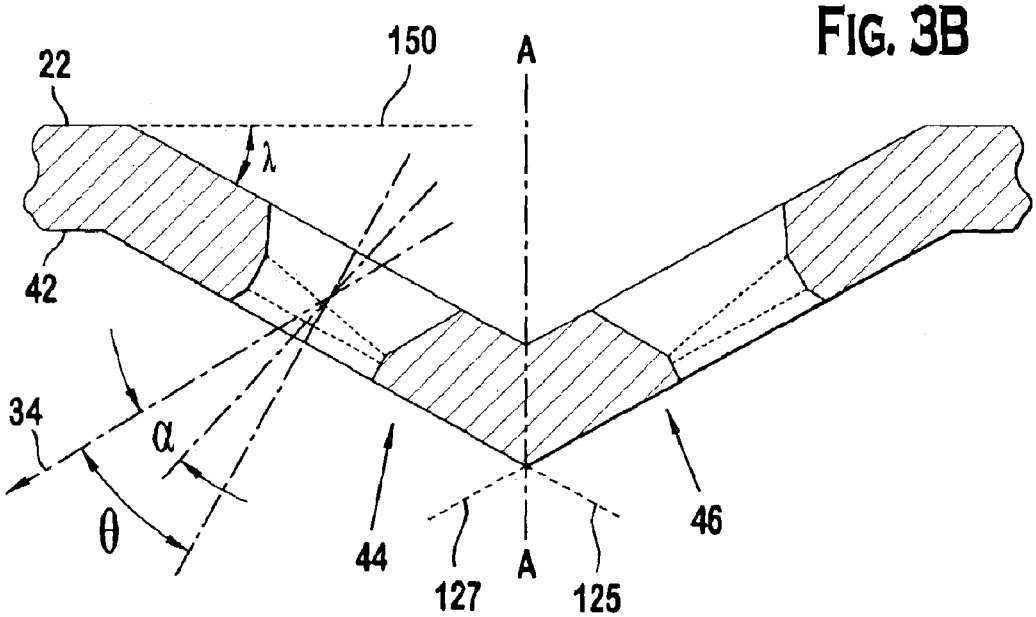
Figure 3C:
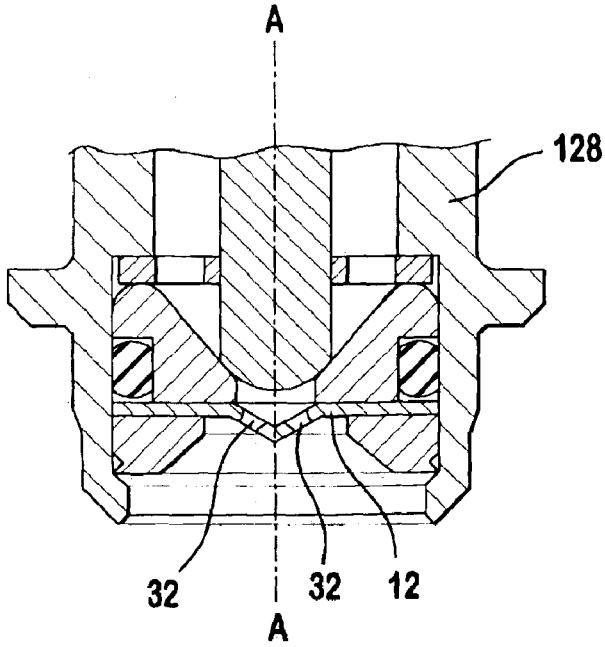

As provided by the preferred embodiments in FIGS. 3A, 3B, and 3C, the orifice angle α can be increased for each of the asymmetrical orifices 32 by dimpling or deforming a region on which the asymmetrical orifice 32 is located. In short, an increased orifice angle 0 of fuel flow 34 can be formed by initially forming the asymmetrical orifice 32 as discussed earlier in a generally flat blank work piece 12 having first surface 22 and second surface 42 (FIG. 3A). Thereafter, the disc blank 12 is dimpled to form at least one planar facet at a dimpling angle λ (FIG. 3B). In this case the new orifice angle θ is a cumulative effect and resultant of the angle α and the angle λ and is related as a function of: (1) the original orifice angle α of fuel flow formed by the asymmetrical orifice geometry and (2) the dimpling angle λ of the dimpled disc blank 12. Thus, the new bending angle θ results from approximately the sum of the orifice angle α and the dimpling angle λ.

The preferred embodiments of the disc blank 12 can be formed by a method as follows. The method includes forming a first asymmetrical orifice 32 penetrating the first and second surfaces 22, 42 (FIG. 3A), respectively, and also includes forming a first facet 44 on which the first orifice 32 is disposed thereon such that the first facet 44 extends generally parallel to a first plane 125 oblique to the base plane 150 (FIG. 3B). Preferably, the first facet 44 can be formed by a suitable technique such as, for example, stamping or drawing such that the first surface 22 becomes a generally concave surface and the second surface 42 becomes a generally convex surface.

A plurality of asymmetrical orifices 32 and so on can be formed at the same time or within a short interval of time with the forming of the first asymmetrical orifice 32. Thereafter, a second facet 46 can be formed at the same time or within a short interval of time with the first facet 44. The second facet 46 can be generally parallel to a second plane 127 oblique to the base plane 150 such that the orifice 32 is oblique to the orifice axis 200. Furthermore, the second facet 46 can also be oblique with respect to the first facet 44. Thereafter, the blank 12 is finished by a suitable finishing technique and installed in a body 128 (FIG. 3C).

The benefits of the asymmetrical geometry of the orifice 32 are believed to be many. The orifice 32 can be formed by two tools moving in a direction perpendicular to the work piece to generate an orifice that emulates an angled orifice without requiring a tool to be oriented oblique to the perpendicular direction. Furthermore, the asymmetrical geometry of the orifice 32 tends to prevent the fuel flow 34 from attaching to the walls of the orifice 32, which feature is believed to permit more of the fuel to be atomized. Moreover, by appropriate configuration of the punch tool, the entry and exit chamfers of the orifice can be formed so that fuel flowing through the orifice can be induced to form a spiral, which may be desirable in certain configurations of the air intake manifold and engine.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A fuel injector for metering, atomizing and spray targeting of fuel, the fuel injector comprising:

a seat including a passage extending along a longitudinal axis;

a movable member cooperating with the seat to permit and prevent a flow of fuel through the passage; and a metering orifice disc including:

a member including first and second generally parallel surfaces, the first surface generally confronting the seat, and the second surface facing opposite the first surface; and an orifice penetrating the member and being defined by a wall coupling the first and second surfaces, the wall including:

a first portion spaced from the first surface, the first portion of the wall extending substantially perpendicular to the first and second generally planar surfaces; and a second portion coupling the first portion to the first surface, the second portion of the wall extending at a first oblique angle with respect to the first surface, and the first oblique angle varying with respect to the longitudinal axis.

2. A fuel injector for metering, atomizing and spray targeting of fuel, the fuel injector comprising:

a seat including a passage extending along a longitudinal axis;

a movable member cooperating with the seat to permit and prevent a flow of fuel through the passage; and a metering orifice disc including:

a member including first and second generally parallel surfaces, the first surface generally confronting the seat, and the second surface facing opposite the first surface; and an orifice penetrating the member and being defined by a wall coupling the first and second surfaces, the orifice targets a spray of fuel along an angular path with respect to the longitudinal axis, the wall including:

a first portion spaced from the first surface, the first portion of the wall extending substantially perpendicular to the first and second generally planar surfaces; and a second portion coupling the first portion to the first surface, the second portion of the wall extending at a first oblique angle with respect to the first surface, and the first oblique angle varying with respect to the longitudinal axis.

3. The fuel injector according to claim 2, wherein the first and second surfaces define respective generally parallel planar facets such that each of the generally planar facets is oblique to the longitudinal axis.

4. A metering orifice disc for a fuel injector including a passage extending between an inlet and an outlet, and a seat proximate the outlet and cooperating with a closure member to permit and prevent a flow of fuel through the passage, the metering orifice disc comprising:

a member including first and second generally parallel surfaces, the first surface being adapted to generally confront the valve seat, and the second surface facing opposite the first surface;

an orifice penetrating the plate and being defined by a wall coupling the first and second surfaces, the wall including:

a first portion spaced from the first surface, the first portion of the wall extending substantially perpendicular to the first and second generally planar surfaces; and a second portion coupling the first portion to the first surface, the second portion of the wall extending at a first oblique angle with respect to the first surface, and the first oblique angle varying so as to define an asymmetrical chamfer.

5. The metering orifice disc according to claim 4, wherein the orifice extends along an orifice axis generally perpendicular to the first and second generally parallel surfaces.

6. The metering orifice disc according to claim 5, wherein the first oblique angle varies about the orifice axis.

7. A metering orifice disc for a fuel injector including a passage extending between an inlet and an outlet, and a seat proximate the outlet and cooperating with a closure member to permit and prevent a flow of fuel through the passage, the metering orifice disc comprising:

a member including first and second generally parallel surfaces, the first surface being adapted to generally confront the valve seat, and the second surface facing opposite the first surface;

an orifice penetrating the plate and being defined by a wall coupling the first and second surfaces, the orifice extending along an orifice axis generally perpendicular to the first and second generally parallel surfaces, and the wall including:

a first portion spaced from the first surface, the first portion of the wall extending substantially perpendicular to the first and second generally planar surfaces; and a second portion coupling the first portion to the first surface, the second portion of the wall extending at a first oblique angle with respect to the first surface, and the first oblique angle varying so as to define an asymmetrical chamfer; and a first perimeter being defined by a juncture of the first surface and the second portion of the wall, the first perimeter being asymmetrical about the orifice axis.

8. The metering orifice disc according to claim 7, wherein the first perimeter is eccentric with respect to the orifice axis.

9. The metering orifice disc according to claim 8, wherein the second perimeter lies in an oblique plane with respect to the orifice axis.

10. The metering orifice disc according to claim 7, further comprising:

a second perimeter being defined by a juncture of the first and second portions of the wall.

11. A metering orifice disc for a fuel injector including a passage extending between an inlet and an outlet, and a seat proximate the outlet and cooperating with a closure member to permit and prevent a flow of fuel through the passage, the metering orifice disc comprising:

a member including first and second generally parallel surfaces, the first surface being adapted to generally confront the valve seat, and the second surface facing opposite the first surface;

an orifice penetrating the plate and being defined by a wall coupling the first and second surfaces, the orifice extending along an orifice axis generally perpendicular to the first and second generally parallel surfaces, and the wall including:

a first portion spaced from the first surface, the first portion of the wall extending substantially perpendicular to the first and second generally planar surfaces; and a second portion coupling the first portion to the first surface, the second portion of the wall extending at a first oblique angle with respect to the first surface, and the first oblique angle varying so as to define an asymmetrical chamfer; and a third portion coupling the first portion to the second surface.

12. The metering orifice disc according to claim 11, wherein the third portion of the wall extends at a second oblique angle with respect to the second surface, and the second oblique angle being generally constant about the orifice axis.

13. The metering orifice disc according to claim 12, further comprising:

a third perimeter being defined by a juncture of the second surface and the third portion of the wall, the third perimeter being irregular and asymmetrical about the orifice axis.

14. The metering orifice disc according to claim 13, wherein the first and second surfaces define respective generally parallel planar facets such that each of the generally planar facets is oblique to the orifice axis.

15. The metering orifice disc according to claim 11, wherein the third portion of the wall comprises an irregular surface.

16. A method of forming an metering orifice disc for a fuel injector, the metering orifice disc including a member having first and second generally parallel surfaces, the method comprising:

forming an orifice penetrating the member, the orifice being defined by a wall coupling the first and second surfaces, and the orifice extending along an orifice axis generally perpendicular to the first and second generally parallel surfaces; and deforming the orifice proximate the first surface, the deforming including forming at least one asymmetrical chamfer with respect to the orifice axis.

17. The method according to claim 16, wherein the forming the orifice comprises at least one of punching, drilling, shaving, and coining.

18. The method according to claim 16, wherein the deforming the orifice comprises at least one of punch forming and coining.

19. A method of forming an metering orifice disc for a fuel injector, the metering orifice disc including a member having first and second generally parallel surfaces, the method comprising:

forming an orifice penetrating the member, the orifice being defined by a wall coupling the first and second surfaces, and the orifice extending along an orifice axis generally perpendicular to the first and second generally parallel surfaces; and deforming the orifice proximate the first surface, the deforming including forming at least one asymmetrical chamfer with respect to the orifice axis and dimpling a region on which the orifice is disposed thereon such that the region forms a facet having a plane oblique to the orifice axis.

* * * * *